US007921507B2

(12) United States Patent
Oh et al.

(10) Patent No.: US 7,921,507 B2
(45) Date of Patent: Apr. 12, 2011

(54) HEATING APPARATUS AND CLEANER HAVING THE SAME

(75) Inventors: Jang-keun Oh, Gwangju (KR); Hyoun-soo Kim, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 301 days.

(21) Appl. No.: 12/078,231

(22) Filed: Mar. 28, 2008

(65) Prior Publication Data

US 2009/0106929 A1 Apr. 30, 2009

(30) Foreign Application Priority Data

Oct. 29, 2007 (KR) ..... 10-2007-0109196

(51) Int. Cl.

| | |
|---|---|
| ***A47L 7/00*** | (2006.01) |
| ***F22B 23/06*** | (2006.01) |
| ***F22B 37/10*** | (2006.01) |
| ***H05B 6/10*** | (2006.01) |

(52) U.S. Cl. ..... 15/320; 122/367.3; 122/DIG. 10; 219/628; 219/630

(58) Field of Classification Search ..... 15/320, 15/302; 122/367.3, DIG. 10, DIG. 11; 219/630, 219/628

See application file for complete search history.

(56) References Cited

U.S. PATENT DOCUMENTS

| | | | | |
|---|---|---|---|---|
| 5,341,541 | A * | 8/1994 | Sham | 15/320 |
| 6,438,793 | B1 * | 8/2002 | Miner et al. | 15/320 |
| 6,571,421 | B1 * | 6/2003 | Sham et al. | 15/320 |
| 6,898,820 | B2 * | 5/2005 | Kasper et al. | 15/320 |
| 2005/0102789 | A1 * | 5/2005 | Hopper | 15/320 |
| 2006/0005345 | A1 * | 1/2006 | Lam | 15/320 |
| 2006/0150363 | A1 * | 7/2006 | Choi | 15/320 |
| 2007/0003461 | A1 * | 1/2007 | Kim | 422/299 |

FOREIGN PATENT DOCUMENTS

| | | |
|---|---|---|
| JP | 09-206257 | 8/1997 |
| JP | 2006-247110 | 9/2006 |

* cited by examiner

*Primary Examiner* — Bryan R Muller
(74) *Attorney, Agent, or Firm* — Blank Rome LLP

(57) ABSTRACT

A heating apparatus and a cleaner having the same are disclosed. The heating apparatus includes a heating casing to receive water from a water container and convert the water into steam, wherein the heating casing comprises a plurality of ribs and each successive rib comprises a space to collect water and convert the water into steam. The cleaner includes a cleaner body in which a water container is detachably mounted, a nozzle assembly rotatably connected to a lower part of the cleaner body and including a nozzle to inject steam, and a heating apparatus that includes a heating casing to receive water from the water container, convert the water into steam, and supply the steam to the nozzle assembly, wherein the heating casing includes a plurality of ribs and each successive rib includes a space to collect water and convert the water into steam.

8 Claims, 7 Drawing Sheets

HEATING APPARATUS AND CLEANER HAVING THE SAME

CROSS-REFERENCE TO RELATED APPLICATIONS

This application claims the benefit under 35 U.S.C. §119 of Korean Patent Application No. 10-2007-0109196, filed on Oct. 29, 2007, in the Korean Intellectual Property Office, the disclosure of which is incorporated herein by reference in its entirety.

FIELD OF THE INVENTION

The present invention relates to a heating apparatus that heats water and converts the water into steam. More particularly, the present invention relates to a heating apparatus that is mounted in a cleaner for dispensing steam onto a cleaning surface.

BACKGROUND OF THE INVENTION

Steam cleaners having a heating apparatus perform cleaning by dispensing steam onto a cleaning surface. The heating apparatus converts water supplied from a water container into steam in a heating casing of the heating apparatus and dispenses the steam on the cleaning surface through a nozzle assembly, causing the cleaning surface to be cleaned.

If a user tilts a conventional steam cleaner in order to use the steam cleaner, the heating apparatus is also operated in a tilted state. In a tilted state, water flows into the heating casing embedded in the heating apparatus. Some of the water is converted into steam while flowing downwards along a surface of the heating casing, but the remainder keeps flowing and is collected in the lowest part of the heating casing where it is then converted into steam. Accordingly, steam is mostly converted from the water collected in the lowest part of the heating casing in a conventional steam cleaner rather than along the surface of the heating casing.

As a result of the water supplied to the heating casing flowing downward along a straight water path and water mostly being converted into steam in the lowest part of the heating casing, there is a problem of low efficiency in forming steam in conventional steam cleaners.

SUMMARY OF THE INVENTION

Accordingly, to solve at least the above problems and/or disadvantages and to provide at least the advantages described below, a non-limiting object of the present invention is to provide a heating apparatus that includes a heating casing to receive water from a water container and convert the water into steam, wherein the heating casing comprises a plurality of ribs and each successive rib comprises a space to collect water and convert the water into steam.

The heating apparatus may include a heating member formed in contact with the heating casing to heat the heating casing, an upper housing that closes an open upper part of the heating casing and comprises a steam discharge pipe to discharge steam formed in the heating casing, and a lower housing that accommodates the heating casing and the heating member and is coupled to the upper housing. Each rib may include a first part and a second part, and the first part may form a step that is lower than the second part, wherein the first part of each successive rib is connected alternately to a left side wall of the heating casing or to a right side wall of the heating casing in a longitudinal direction of the heating casing so that the first part, the side wall, and a bottom surface of the heating casing form a water collecting groove. The heating member may be formed as a sheath heater. The heating casing may be formed of a thermally conductive material. The heating apparatus may further comprise a heating member cover which is connected to a bottom surface of the heating casing to cover the heating member.

According to another exemplary aspect of the present invention, there is provided a cleaner including a cleaner body in which a water container is detachably mounted, a nozzle assembly rotatably connected to a lower part of the cleaner body and including a nozzle to inject steam, and a heating apparatus that includes a heating casing to receive water from the water container, convert the water into steam, and supply the steam to the nozzle assembly, wherein the heating casing includes a plurality of ribs and each successive rib includes a space to collect water and convert the water into steam.

BRIEF DESCRIPTION OF THE DRAWINGS

The above and other aspects of the present invention will be more apparent from the following detailed description of exemplary embodiments with reference to the accompanying drawings, in which.

DETAILED DESCRIPTION OF EXEMPLARY EMBODIMENTS OF THE INVENTION

Figure 1:
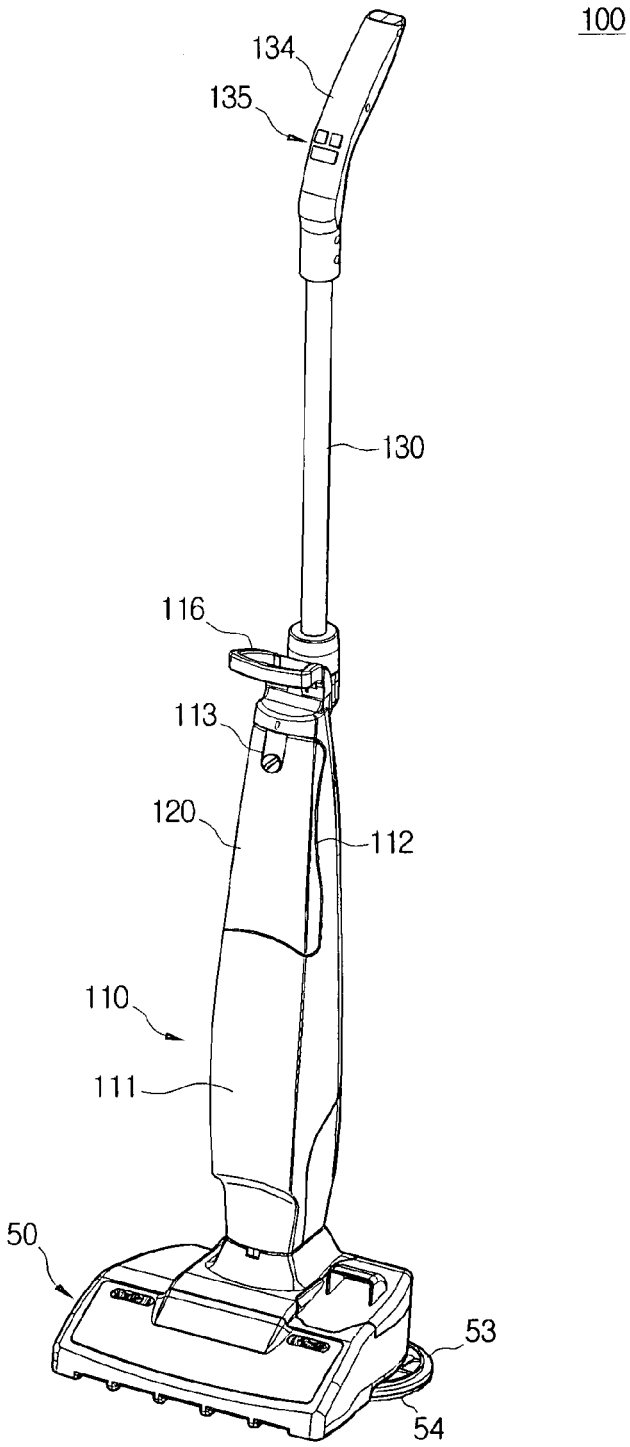
FIG. 1 is an isometric view illustrating a cleaner having a heating apparatus according to an exemplary embodiment of the present invention.

Reference will now be made in detail to non-limiting embodiments of the present invention by way of reference to the accompanying drawings, wherein like reference numerals refer to like parts, components and structures.

According to exemplary embodiments of the present invention, a cleaner 100 having a heating apparatus 200 is described hereinafter with reference to the drawings.

The cleaner 100 according to exemplary embodiments of the present invention includes a steam cleaning function and a vacuum cleaning function. The distinctive feature of the present invention is the heater apparatus 200 for steam cleaning, so the configuration of the heating apparatus 200 is described in detail and the remaining configuration is described briefly.

Figure 2:
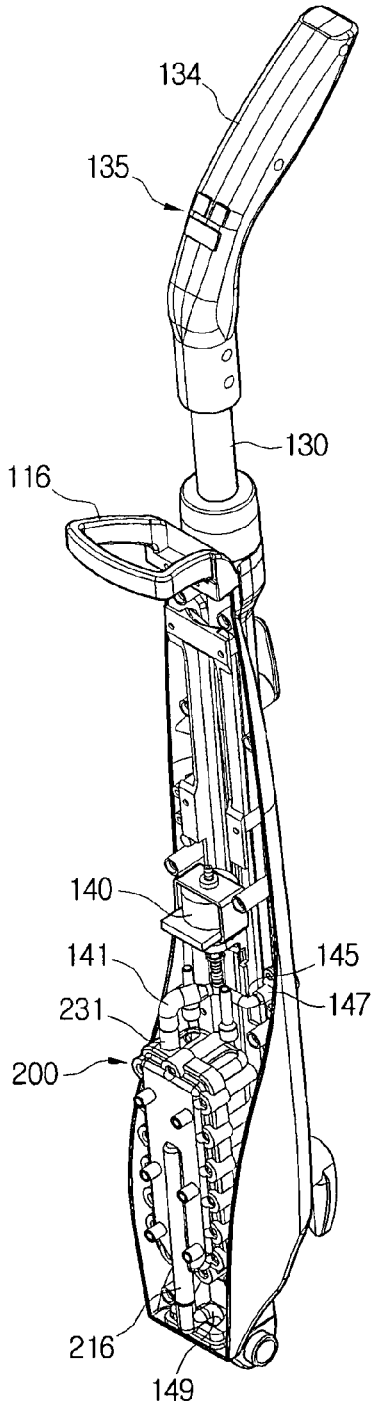
FIG. 2 is an isometric view illustrating the inside of the cleaner of FIG. 1 when a front cover is removed.

With reference to FIGS. 1 and 2, the cleaner 100 includes a nozzle assembly 50, a cleaner body 110, and the heating apparatus 200.

The nozzle assembly 50 is rotatably connected to a lower part of the cleaner body 110, and the nozzle assembly 50 includes a suction motor and a dust collecting apparatus (not shown) to suck in dust from a cleaning surface and separate dust from in-drawn air. At least one dust cloth board 53 is rotatably formed at a lower surface of the back of the nozzle assembly 50, and a dust cloth 54 can be detachably connected to the dust cloth board 53. For example, Velcro fasteners (not shown) can be formed under the dust cloth board 53 to detachably connect the dust cloth 54 to the dust cloth board 53.

The cleaner body 110 includes a front cover 111, a water container housing 112 formed above the front cover 111 to detachably accommodate a water container 120, and a locking member 113 to lock and unlock the water container 120. Additionally, a conveyance handle 116 is formed on one side of the upper part of the cleaner body 110 in order for a user to hold and carry the cleaner 100 with ease.

A structure to supply water from the water container 120 to the heating apparatus 200 is formed inside the cleaner body 110 according to an exemplary embodiment of the present invention. As shown in FIG. 2, a pump 140 is formed inside the cleaner body 110 to receive water from the water container 120 and supply a certain amount of water to the heating apparatus 200 through a water supply pipe 141. A discharge pipe 145 is formed on one side of the water supply pipe 141 to be in fluid communication with the outside of the cleaner body 110, and a safety valve 147 is formed in the discharge pipe 145. The safety valve 147 prevents water supplied from the pump 140 from flowing back into the pump 140 due to pressure generated in the heating apparatus 200 so that the water can properly flow into the heating apparatus 200. The discharge pipe 145 functions as a passage through which water is discharged outside the cleaner body 110.

A steam supply pipe 149 is formed on the cleaner body 110 to be in fluid communication with a steam discharge pipe 216 of the heating apparatus 200 so as to dispense steam formed by the heating apparatus 200 from under the nozzle assembly 50.

A stick unit 130 is formed at the back of the cleaner body 110 to be longitudinally slidable in order to be inserted into or to protrude from the cleaner body 110. A manipulation handle 134 is formed above the stick unit 130 to be held by the user. A button unit 135 is formed on the manipulation handle 134 in order for the user to manipulate the suction motor (not shown) in the nozzle assembly 50 and the heating apparatus 200.

Figure 3:
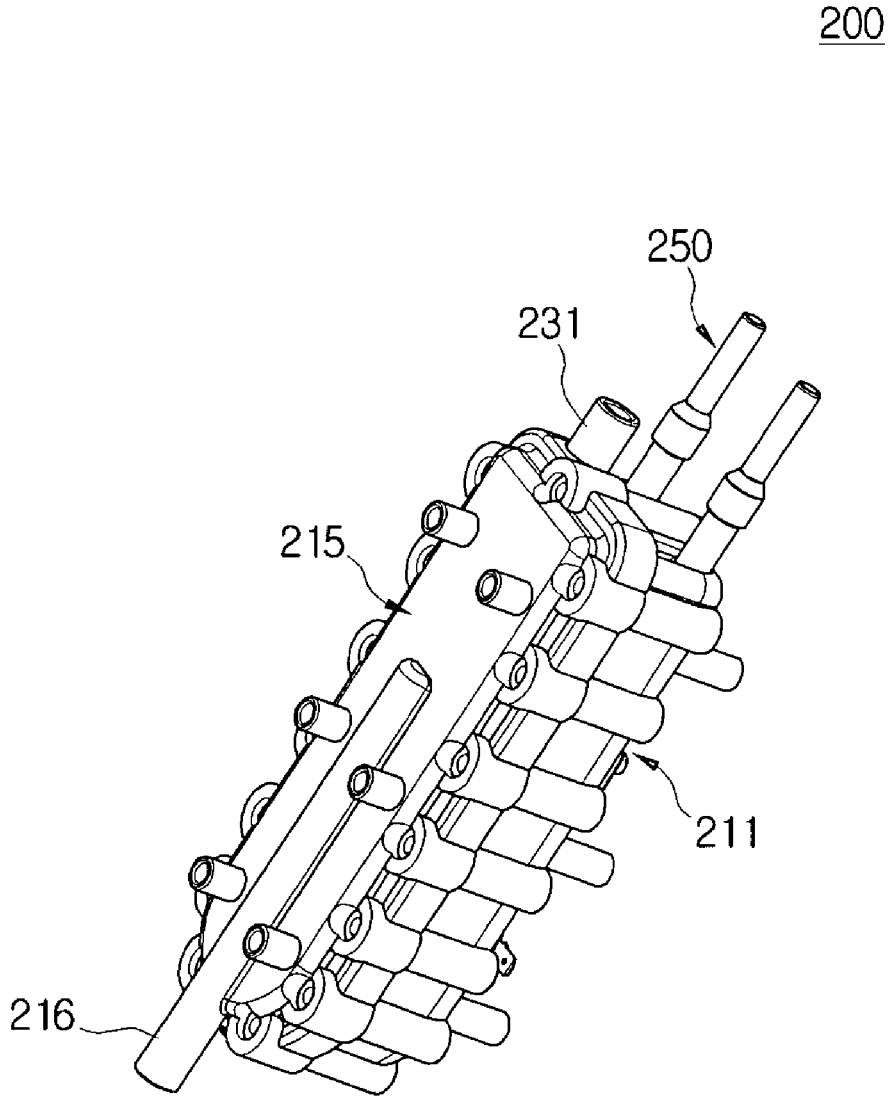
FIG. 3 is an isometric view illustrating a heating apparatus according to an exemplary embodiment of the present invention.
Figure 4:
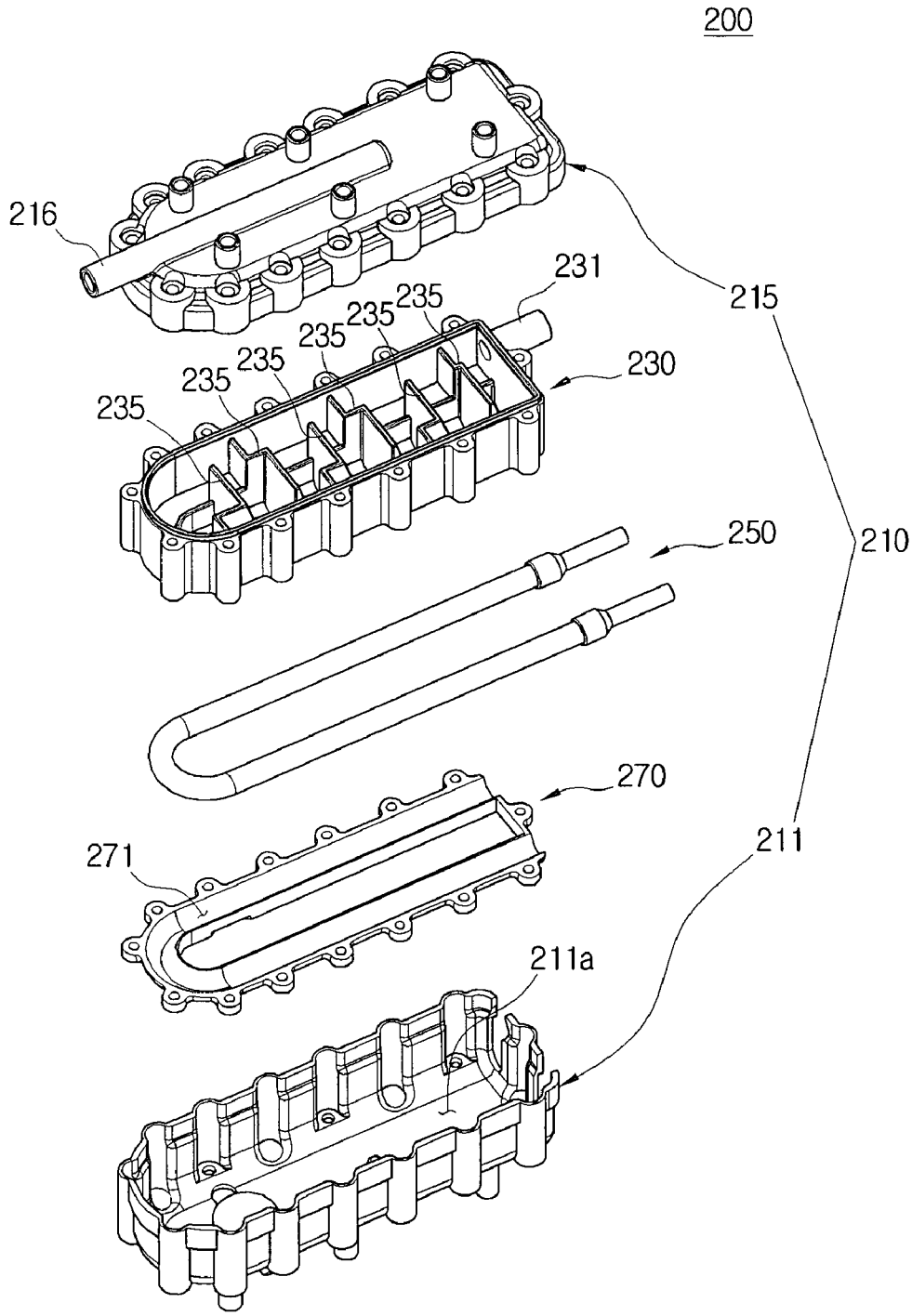
FIG. 4 is an exploded isometric view illustrating the heating apparatus of FIG. 3 when the heating apparatus is viewed from the top.
Figure 5:
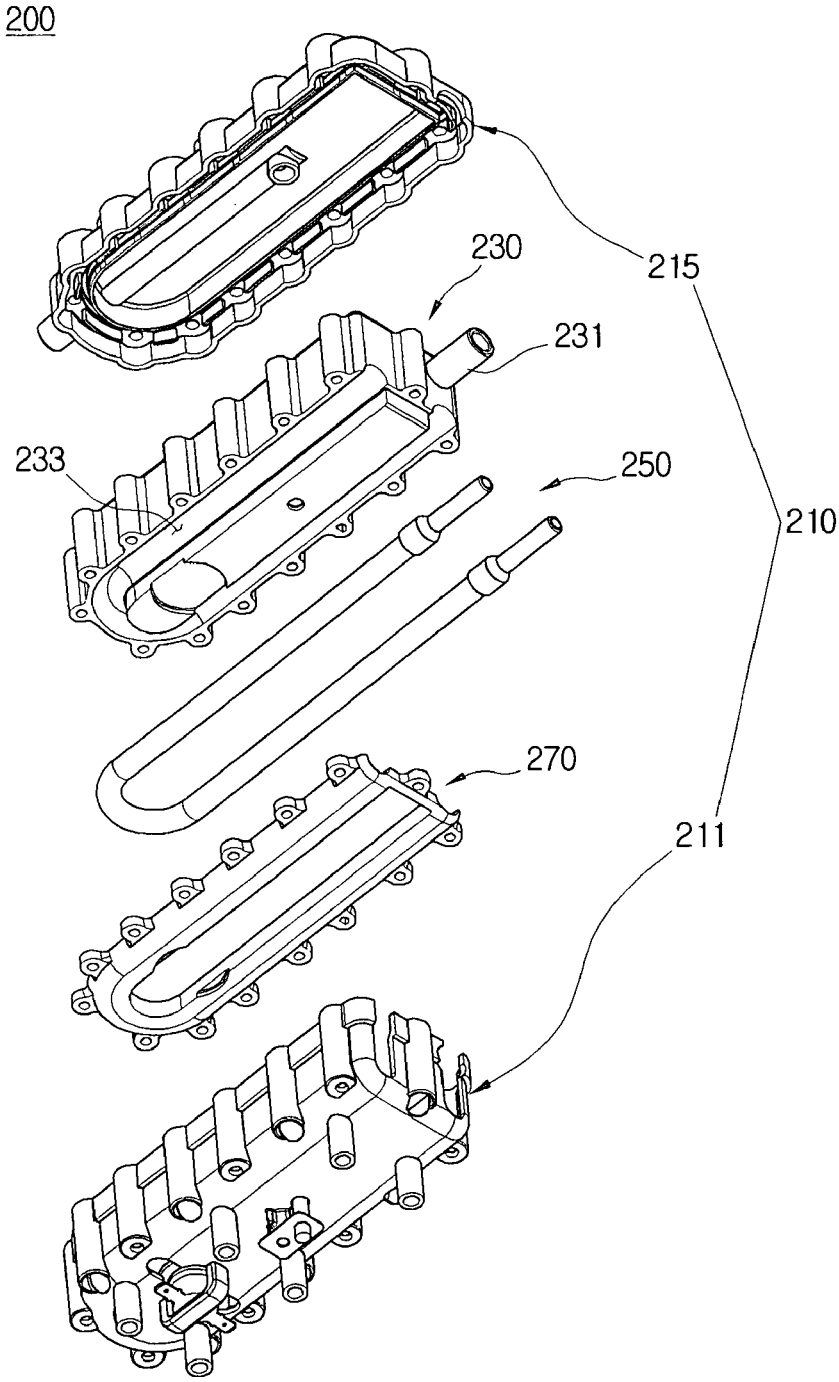
FIG. 5 is an exploded isometric view illustrating the heating apparatus of FIG. 3 when the heating apparatus is viewed from the bottom.
Figure 6:
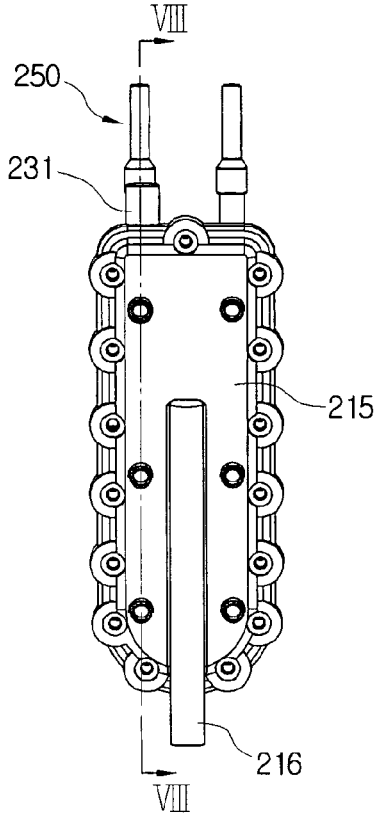
FIG. 6 is a top view illustrating the heating apparatus of FIG. 3.

With reference to FIGS. 3 to 5, the heating apparatus 200 according to an exemplary embodiment of the present invention receives water from the water container 120, forms steam, and transmits the steam to the nozzle assembly 50 through the steam supply pipe 149. The heating apparatus 200 includes a housing 210, a heating casing 230, a heating member 250, and a heating member cover 270.

The housing 210 includes an upper housing 215 and a lower housing 211. The heating casing 230, the heating member 250, and the heating member cover 270 are disposed between the upper housing 215 and the lower housing 211.

A steam discharging pipe 216 is formed on an upper part of the upper housing 215 along the longitudinal direction of the upper housing 215. One side of the steam discharge pipe 216 has a steam discharge hole 216*a* (see FIG. 8) to be in fluid communication with a space formed by the upper housing 215 and the heating casing 230, and the other side of the steam discharge pipe 216 is in fluid communication with the steam supply pipe 149 (see FIG. 2).

The upper part of the lower housing 211 is open so that the lower housing 211 may be coupled to the lower part of the upper housing 215. The lower housing 211 includes a receiving groove 211*a* (see FIG. 4) to accommodate the heating member cover 270, the heating member 250, and the heating casing 230 through the open upper part of the lower housing 211.

The upper part of the heating casing 230 is open, and the heating casing 230 includes a water receiving pipe 231 which is connected to the water supply pipe 141 in order to receive water from the water container 120. The heating casing 230 is connected to the upper housing 215 so that a space can be formed for generating steam.

Figure 8:
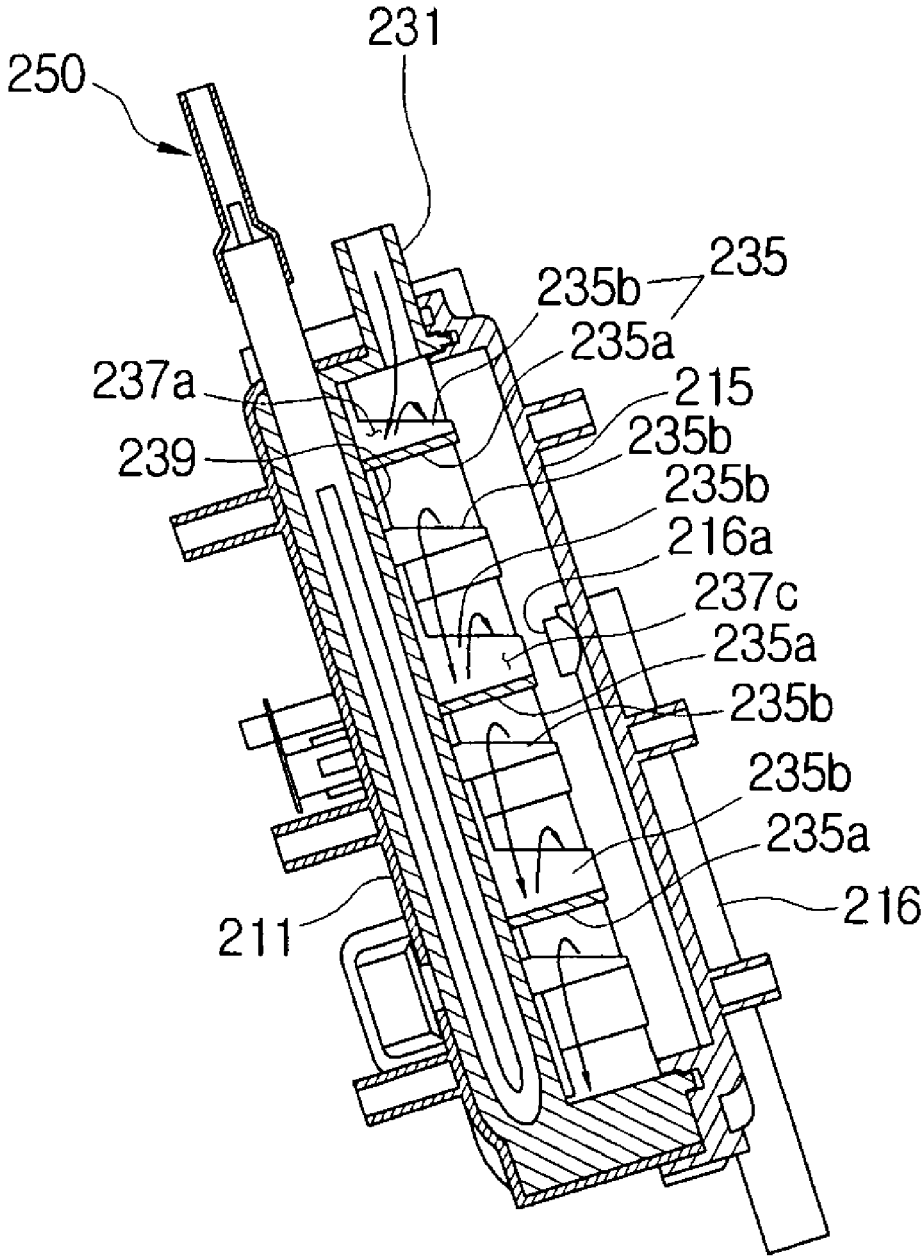
FIG. 8 is a sectional view illustrating the heating apparatus cut along line VIII-VIII of FIG. 6 when the cleaner is tilted for cleaning.

When the cleaner 100 according to an exemplary embodiment of the present invention is used for cleaning, the cleaner 100 is tilted approximately 45° with respect to a cleaning surface (see FIG. 8). Accordingly, water flowing into the heating casing 230 through the water receiving pipe 231 flows downwards in contact with the tilted heating casing 230. The heating apparatus 200 according to an exemplary embodiment of the present invention includes a plurality of ribs 235 inside the heating casing 230 so that the water entering the heating casing 230 cannot directly fall to the lowest part of the heating casing 230 but can follow a zigzag course along the plurality of ribs 235 of the heating casing 230. Therefore, most of the steam forms at a plurality of water collecting grooves 237 formed inside the heating casing 230, so the efficiency with which steam is formed can be increased.

Figure 7:
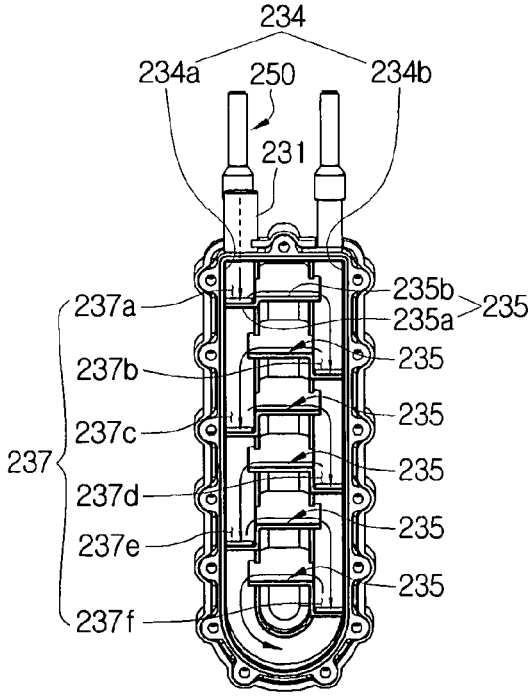
FIG. 7 is a top view illustrating the heating apparatus of FIG. 3 when an upper housing of the heating apparatus is removed.

To form the individual water collecting grooves 237*a*, 237*b*, 237*c*, 237*d*, 237*e*, and 237*f*, each rib 235 includes a first part 235*a* and a second part 235*b*, wherein the first part 235*a* forms a step which is lower than the second part 235*b*, as shown in FIGS. 4 and 7. The first part 235*a* is connected to a side wall 234 and bottom surface of the heating casing 230 so that each water collecting groove 237 is formed. The ribs 235 are formed from top to bottom and the first part 235*a* of each successive rib 235 is connected alternately to the left side wall 234*a* and the bottom surface of the heating casing 230 and to the right side wall 234*b* and the bottom surface of the heating casing 230. Accordingly, as shown in FIG. 7, the first part 235*a* of the first rib 235 is connected to the left side wall 234*a*, and the first part 235*a* of the second rib 235 is connected to the right side wall 234*b*. Therefore, the plurality of water collecting grooves 237 are formed alternately on the left and the right of the heating casing at regular, alternating intervals. The ribs 235 according to an exemplary embodiment of the present invention may be integrally formed on the heating casing 230 to receive heat from the heating casing 230.

Six ribs 235 are formed in this exemplary embodiment of the present invention, but more ribs 235 may be formed in order to have more water collecting grooves 237. The plurality of water collecting grooves in the heating casing 230 have been labeled until now with reference number 237, but are labeled hereinafter as the first to sixth water collecting grooves 237*a* to 237*f* for more detailed description.

A heating member housing groove 233 is formed on the bottom surface of the heating casing 230 in a substantially "U" shape to accommodate the heating member 250. The heating casing 230 is in contact with the heating member 250 at the bottom so that the heating casing 230 can be heated to a temperature at which water is converted into steam by the heating member 250. In the exemplary embodiment of the present invention, the heating casing 230 may be formed of a thermally conductive material to increase the thermal conductivity efficiency of the heating member 250.

The heating member 250 is formed substantially in a "U" shape to correspond to the heating member housing groove 233 and is housed in the heating member housing groove 233 and fixed by the heating member cover 270 to heat the heating casing 230. The heating member 250 is disposed close to the first to sixth water collecting grooves 237*a* to 237*f*. In the exemplary embodiment of the present invention, the heating member 250 is formed as a sheath heater, but any of a diverse number of heaters to supply heat to the heating casing 230 can also be utilized.

The heating member cover 270 has a fixing groove 271 which is formed in a "U" shape to correspond to the heating member 250 and to fix the heating member 250 within the heating member housing groove 233 when the heating member cover 370 is connected to the heating casing 230.

In the exemplary embodiment of the present invention, the amount of water collected in the first water collecting groove 237*a* may be smaller than that collected in the second to sixth water collecting grooves 237*b* to 237*f*. Accordingly, the first part 235*a* of the rib 235 which is disposed the highest in the heating casing 230 may have a stepped depth lower than that of the remaining ribs 235. This is because the part of the heating member 250 corresponding to the first water collecting groove 237*a* has a lower temperature than the remaining part, so the first water collecting groove 237*a* of the heated heating casing 230 has a lower temperature than the second to sixth water collecting grooves 237*b* to 237*f*. Therefore, the amount of water collected in the first water collecting groove 237*a* needs to be smaller than that collected in the remaining water collecting grooves 237*b* to 237*f*.

Hereinafter, the operation of the heating apparatus 200 according to an exemplary embodiment of the present invention is described with reference to FIGS. 1, 2, 7, and 8.

As illustrated in FIG. 8, if the user tilts the cleaner 100 for cleaning, the heating apparatus 200 is tilted. The heating casing 230 is heated to a temperature for forming steam by the heating member 250 and the pump 140 operates so water in the water container 120 is moved through the water supply pipe 141 to the water receiving pipe 231.

With reference to FIGS. 7 and 8, the water flowing into the heating casing 230 through the water receiving pipe 231 is collected in the first water collecting groove 237*a* which is the highest in the heating casing 230. The water in the first water collecting groove 237*a* starts being collected from a part where the first part 235*a* of the rib 235 and the bottom surface 239 of the heating casing 230 are connected since the heating apparatus 200 is tilted as shown in FIG. 8 and the first part 235*a* of the rib 235 is thus tilted. The water collected in the first water collecting groove 237*a* is converted into steam. Subsequently, if water continuously flows into the heating casing 230, the capacity of the first water collecting groove 237*a* for retaining water is exceeded, so the water flows downwards to the second water collecting groove 237*b* through the second part 235*b* of the highest rib 235.

During the movement of the water, the water is in contact with the bottom surface of the heating casing 230, and a part of the water is converted into steam. Subsequently, the water is collected in the second water collecting groove 237*b* and converted into steam. If water continues to flow into the heating casing 230, the capacity of the second water collecting groove 237*b* for retaining water is exceeded, so the water flows downwards to the third water collecting groove 237*c* through the second part 235*b* of the second highest rib 235.

During the movement of the water, the water is in contact with the bottom surface of the heating casing 230, and a part of the water is converted into steam. Subsequently, the water is collected in the third water collecting groove 237*c* and converted into steam. This process is repeated through the fourth to sixth water collecting groove 237*d*, 237*e*, and 237*f*, so the water successively flows into the fourth to sixth water collecting groove 237*d*, 237*e*, and 237*f*, and then converted into steam. Finally, the water is collected in the lowest part of the heating casing 230 and converted into steam.

As described above, water flows through the first to sixth water collecting grooves 237*a* to 237*f* along a zigzag path in the heating casing 230. Most of the water is converted into steam in the first to sixth water collecting grooves 237*a* to 237*f*, and the steam is discharged from the heating apparatus 200 through the steam discharge pipe 216. The discharged steam is dispensed from under the nozzle assembly 50 through the steam supply pipe 149 formed in the cleaner body 110. Following such a process, steam cleaning is performed.

As described above, the heating apparatus 200 according to the exemplary embodiment of the present invention includes the plurality of stepped ribs 235 in the heating casing 230 and the first to sixth water collecting grooves 237*a* to 237*f* so that the number of locations at which steam is formed are increased and the efficiency of forming steam can thus increase.

While certain exemplary embodiments of the present invention have been shown and described with reference to certain preferred embodiments thereof, it will be understood by those skilled in the art that various changes in form and details may be made therein without departing from the spirit and scope of the invention as defined by the appended claims and their equivalents.

What is claimed is:

1. A cleaner, comprising:

a cleaner body in which a water container is detachably mounted;

a nozzle assembly rotatably connected to a lower part of the cleaner body that is configured to dispense steam; and a heating apparatus that includes a heating casing to receive water from the water container, convert the water into steam, and supply the steam to the nozzle assembly, wherein the heating apparatus further comprises:

a heating member formed in contact with the heating casing to heat the heating casing;

a lower housing that is formed separately from the heating casing and that accommodates the heating casing and the heating member; and an upper housing that closes an open upper part of the heating casing disposed inside the lower housing, includes a steam discharge hole to discharge steam formed in the heating casing, and is separately coupled to the lower housing, wherein the heating casing includes a plurality of ribs and each successive rib includes a space to collect water and convert the water into steam.

2. The cleaner of claim 1, wherein each rib includes a first part and a second part and the first part forms a step that is lower than the second part in a lengthwise direction of the heating casing, and wherein the first part of each successive rib is connected alternately to a left side wall of the heating casing or to a right side wall of the heating casing in a longitudinal direction of the heating casing so that the first part, the side wall, and a bottom surface of the heating casing form a water collecting groove.

3. The cleaner of claim 1, wherein the heating member is formed as a sheath heater.

4. The cleaner of claim 1, wherein the heating casing is formed of a thermally conductive material.

5. The cleaner of claim 1, further comprising a heating member cover which is connected to a bottom surface of the heating casing to cover the heating member.

6. The cleaner of claim 1, wherein an open space is formed between the upper housing and the plurality of ribs in the heating casing over the plurality of ribs; and the steam discharge hole is in fluid communication with the open space to discharge steam formed in the heating casing.

7. The cleaner of claim 1, wherein the plurality of ribs are disposed substantially parallel to one another; and water flows downward from a preceding rib to a succeeding rib as a capacity for retaining water of the preceding rib is exceeded such that steam is generated at each of the plurality of ribs where water is flowing.

8. The cleaner of claim 2, wherein a capacity of a water collecting groove formed by a rib disposed nearest to a water receiving pipe in a lengthwise direction of the heating casing among the plurality of ribs is less than a capacity of a water collecting groove formed by the other ribs.

* * * * *